US009245682B2

(12) United States Patent
Miura et al.

(10) Patent No.: US 9,245,682 B2
(45) Date of Patent: Jan. 26, 2016

(54) TRANSFORMER

(75) Inventors: Hiroki Miura, Tokyo (JP); Hironobu Takahashi, Nagaokakyo (JP); Keiichi Ichikawa, Nagaokakyo (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

(21) Appl. No.: 14/236,526

(22) PCT Filed: Apr. 25, 2012

(86) PCT No.: PCT/JP2012/061050
§ 371 (c)(1),
(2), (4) Date: Jan. 31, 2014

(87) PCT Pub. No.: WO2013/027447
PCT Pub. Date: Feb. 28, 2013

(65) Prior Publication Data
US 2014/0159852 A1 Jun. 12, 2014

(30) Foreign Application Priority Data
Aug. 24, 2011 (JP) ..... 2011-183049

(51) Int. Cl.
*H01F 27/30* (2006.01)
*H01F 27/28* (2006.01)
*H01F 27/29* (2006.01)
(Continued)

(52) U.S. Cl.
CPC ..... *H01F 27/02* (2013.01); *H01F 27/325* (2013.01); *H01F 38/10* (2013.01)

(58) Field of Classification Search
CPC ..... H01F 5/02; H01F 27/325; H01F 27/38; H01F 27/02; H01F 38/10
USPC ..... 336/198, 208, 182, 212, 220
See application file for complete search history.

(56) References Cited

U.S. PATENT DOCUMENTS 4,916,424 A * 4/1990 Kijima ..... 336/160
5,404,123 A * 4/1995 Joseph ..... 336/192
(Continued)

FOREIGN PATENT DOCUMENTS

CN 1037428 A 11/1989
JP A-1-173704 7/1989
(Continued)

OTHER PUBLICATIONS

Written Opinion of the International Searching Authority issued in International Application No. PCT/JP2012/061050 mailed Jun. 26, 2012.
(Continued)

*Primary Examiner* — Mangtin Lian
(74) *Attorney, Agent, or Firm* — Oliff PLC

(57) ABSTRACT

To greatly improve the productivity, the general versatility, the downsizing, the performance and the like, as compared to those of the conventional transformer, provided is a transformer including: a core; a primary winding; a secondary winding; a bobbin provided with a low voltage side coil winding portion and a high voltage side coil winding portion, wherein the secondary winding is wound onto each of the coil winding portions; and a casing disposed so as to cover an outer periphery of the bobbin, wherein the primary winding is wound onto a portion of an outer periphery of the casing corresponding to a position of the low voltage side coil winding portion.

11 Claims, 9 Drawing Sheets

(51) Int. Cl.

| | |
|---|---|
| ***H01F 27/02*** | (2006.01) |
| ***H01F 27/32*** | (2006.01) |
| ***H01F 38/10*** | (2006.01) |

(56) References Cited

U.S. PATENT DOCUMENTS

| | | | | |
|---|---|---|---|---|
| 6,154,113 | A * | 11/2000 | Murai | 336/198 |
| 2002/0180572 | A1 | 12/2002 | Kakehashi et al. | |
| 2005/0104698 | A1 | 5/2005 | Kakehashi et al. | |
| 2006/0066430 | A1 | 3/2006 | Nakano et al. | |
| 2007/0132535 | A1 | 6/2007 | Kakehashi et al. | |
| 2008/0024261 | A1 * | 1/2008 | Shinmen et al. | 336/208 |
| 2009/0108979 | A1 * | 4/2009 | Kosugi et al. | 336/208 |
| 2010/0231343 | A1 * | 9/2010 | Zeng et al. | 336/192 |

FOREIGN PATENT DOCUMENTS

| | | | |
|---|---|---|---|
| JP | A-5-283245 | | 10/1993 |
| JP | A-6-244033 | | 9/1994 |
| JP | H06-267764 | A | 9/1994 |
| JP | A-8-130127 | | 5/1996 |
| JP | 2000-012350 | A | 1/2000 |
| JP | A-2000-36416 | | 2/2000 |
| JP | A-2002-93635 | | 3/2002 |
| JP | A-2002-217050 | | 8/2002 |
| JP | A-2004-14832 | | 1/2004 |
| JP | 2007-281190 | A | 10/2007 |
| KR | 2009-0042156 | A | 4/2009 |
| WO | WO 2004/019353 | A1 | 3/2004 |

OTHER PUBLICATIONS

International Search Report issued in International Application No. PCT/JP2012/061050 mailed Jun. 26, 2012.

Jan. 23, 2015 Office Action issued in Korean Application No. 10-2014-7004767.

Nov. 4, 2015 Chinese Office Action issued in Chinese Application No. 201280039799.4.

* cited by examiner

TRANSFORMER

TECHNICAL FIELD

The present invention relates to a transformer for use in, for example, a circuit for lighting a vehicle headlamp using a metal halide lamp or a circuit for converting a high voltage to a low voltage.

BACKGROUND ART

Conventionally, when a high voltage discharge lamp (for example, metal halide lamp) which needs a high voltage at startup is used as a vehicle headlamp, a high voltage transformer which outputs a high voltage have been used, as disclosed in Japanese Laid-open Patent Application Publication No. 8-130127 (Patent Literature 1), for example.

The conventional high voltage transformer, as disclosed in Japanese Laid-open Patent Application Publication No. 8-130127 (Patent Literature 1), is constituted by a core, a hollow cylindrical shaped spool into the hollow portion of which the core is inserted, a secondary winding wound around the outer periphery of the spool, a casing made of a resin covering the spool being wound with the secondary winding, and a primary winding being inserted into the casing. The core, the spool and the secondary winding are housed in the casing, covered with a filled resin, and are fixed and integrated. Further, it is disclosed in Japanese Laid-open Patent Application Publication No. 8-130127 (Patent Literature 1) that by inserting the both ends of the primary winding being disposed on the casing of a printed circuit board, the core, the spool, the secondary winding, the casing and the printed circuit board are integrated, and the high voltage transformer is configured.

CITATION LIST

Patent Literature

Patent Literature 1: Japanese Laid-open Patent Application Publication No. 8-130127

SUMMARY OF INVENTION

Technical Problem

As described above, with regard to the structure in which the casing is inserted to the printed circuit board and secured integrally by filling the resin material into the space between the outer periphery of the spool and the inner surface of the casing, like the transformer as known in Japanese Laid-open Patent Application Publication No. 8-130127 (Patent Literature 1), the positions of the through-holes are different depending on the arrangement of the circuit and the like of the printed circuit board, and so there is a problem that general versatility is lacked.

In addition, because a work of filling the resin material into the space between the outer periphery of the spool and the inner surface of the casing is required, the assembling work grows complicated, the working man-hours increase, and further, some waiting time for curing of the filled resin material is needed. Therefore, there is a problem that productivity grows poor as a whole and cost increase is induced.

Thus, the present invention has been made in view of the above described problems, and the object of the present invention is to provide a transformer that can greatly improve the productivity, the general versatility, the downsizing, the performance and the like, as compared to those of the conventional transformer.

Solution to Problem

In order to achieve the above described object, a transformer according to the present invention comprises: a core; a primary winding; a secondary winding; a bobbin provided with a low voltage side coil winding portion and a high voltage side coil winding portion, wherein the secondary winding is wound onto each of the coil winding portions; and a casing disposed so as to cover an outer periphery of the bobbin, wherein the primary winding is wound onto a portion of an outer periphery of the casing corresponding to a position of the low voltage side coil winding portion.

According to the configuration, the transformer can be formed by covering the outer periphery of the bobbin onto which the secondary winding is wound, with the casing, and winding the primary winding onto the portion of the outer periphery of the casing corresponding to the position of the low voltage side coil winding portion. In this way, by winding the primary winding to the portion overlapping with the low voltage side winding of the secondary winding, the parasitic capacitance generated in the high voltage side winding of the secondary winding by the primary winding can be reduced. Accordingly, the electric power loss at high frequencies can be reduced. Further, because the energy stored in the parasitic capacitance increases with increasing potential between the primary winding and the secondary winding, it is possible to reduce the energy stored in the parasitic capacitance, and thereby reduce the electric power loss due to leakage current at high frequencies, by winding the primary winding over the outer periphery of the low voltage side coil winding of the secondary winding. In addition, insulation properties between the primary winding and the secondary winding can be assured.

In the above described configuration, a configuration can be employed where the secondary winding is a high voltage winding and the primary winding is a low voltage winding, and the primary winding is placed and wound in a portion corresponding to an area between the both ends of the low voltage side coil winding portion.

According to the configuration, by placing the primary winding in the portion corresponding to the region between the both ends of the low voltage coil winding portion and winding the primary winding therein, the distance between the high voltage side coil winding of the secondary winding and the low voltage side coil winding of the secondary winding, and the distance between the low voltage side coil winding of the secondary winding and the primary winding can be gotten closer. Accordingly, the coupling coefficient grows larger and so a high coupling is obtained. In addition, the length of the transformer in the longitudinal direction can be shortened by winding the primary winding onto the outer periphery of the casing.

In the above described configuration, a configuration can be employed where the casing is formed in a hollow box-shaped body provided with an opening on a lower surface of the outer periphery thereof for receiving and accommodating the bobbin therein, and the opening has a retaining protrusion to engage the accommodated bobbin.

According to the configuration, by covering the bobbin with the casing from the upper side of the bobbin and accommodating the bobbin to a predetermined position in the case from the opening of the outer periphery lower surface of the casing, the bobbin is covered with the casing and the retaining protrusion engages the bobbin, and then the bobbin and the casing are fixed together. Thereby, the work of filling an insulation resin or the like between the casing and the bobbin and of fixing the bobbin and the casing becomes unnecessary. In addition, in a case the bobbin is accommodated in the casing from the terminal block portion side in the longitudinal direction of the bobbin, it is necessary to provide an opening having a size capable of passing the terminal block portion attached to the bobbin, and so the overall size of the casing grows larger. However, as disclosed in this configuration, in the case the opening is provided to the lower surface of the casing and the bobbin is covered with the casing from the upper side of the bobbin, it is enough to provide an opening having at least a size of the outer diameter of the bobbin and so the size of the bobbin can be reduced.

In the above described configuration, a configuration can be employed where the casing is provided with an insulation tape onto the outer periphery thereof where the primary winding is wound.

According to the configuration, insulation properties between the primary winding wound onto the outer periphery of the casing and the secondary winding wound onto the outer periphery of the bobbin can be assured by the insulation tape.

In the above described configuration, a configuration can be employed where the core comprises an I type magnetic body core and a C type magnetic body core.

According to the configuration, the I type magnetic material core and the C type magnetic material core form a closed magnetic circuit and so the magnetic flux leakage can be reduced.

Advantageous Effects of Invention

According to the present invention, the bobbin and the casing are integrated by covering the outer periphery of the bobbin onto which the secondary winding is wound, with the casing, and winding the primary winding onto the portion of the outer periphery of the casing corresponding to the position of the low voltage side coil winding portion. As a result, for assuring the insulation properties between the secondary winding and the primary winding, the resin material which has been filled into the space between the secondary winding and the primary winding conventionally can be omitted and the work can be simplified, and so it becomes possible to promote reduction of man-hours of the work and to expect increase of productivity. In addition, because the coupling coefficient between the secondary winding and the primary winding grows larger and so a high coupling can be obtained, by getting closer the distance between the secondary winding and the primary winding, the higher performance can be expected.

Further, in the present invention, the casing and the bobbin are configured to be fixed and secured, by attaching the casing so as to cover the bobbin. This is different from the conventional transformer in which the casing and the bobbin are integrated by using through-holes and the like of the printed circuit board side. As a result, a product having general versatility is obtained without depending on the shape of the printed circuit board and the like. Accordingly, further improvement of productivity, simplification of the shape, downsizing and the like can be expected.

DESCRIPTION OF EMBODIMENTS

Hereinafter, embodiments for carrying out the present invention (hereinafter referred to as "embodiment") shall be described in detail with reference to the accompanying drawings.

Figure 1:
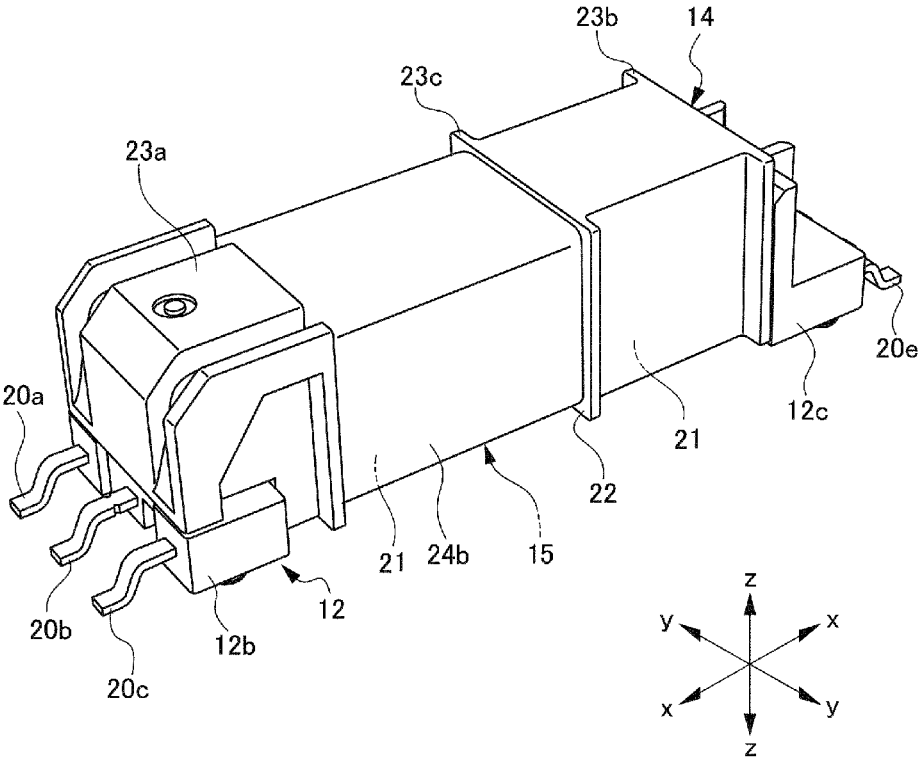
FIG. 1 is an external perspective view of a transformer according to one embodiment of the present invention, viewed from the front side obliquely upward direction.
Figure 2:
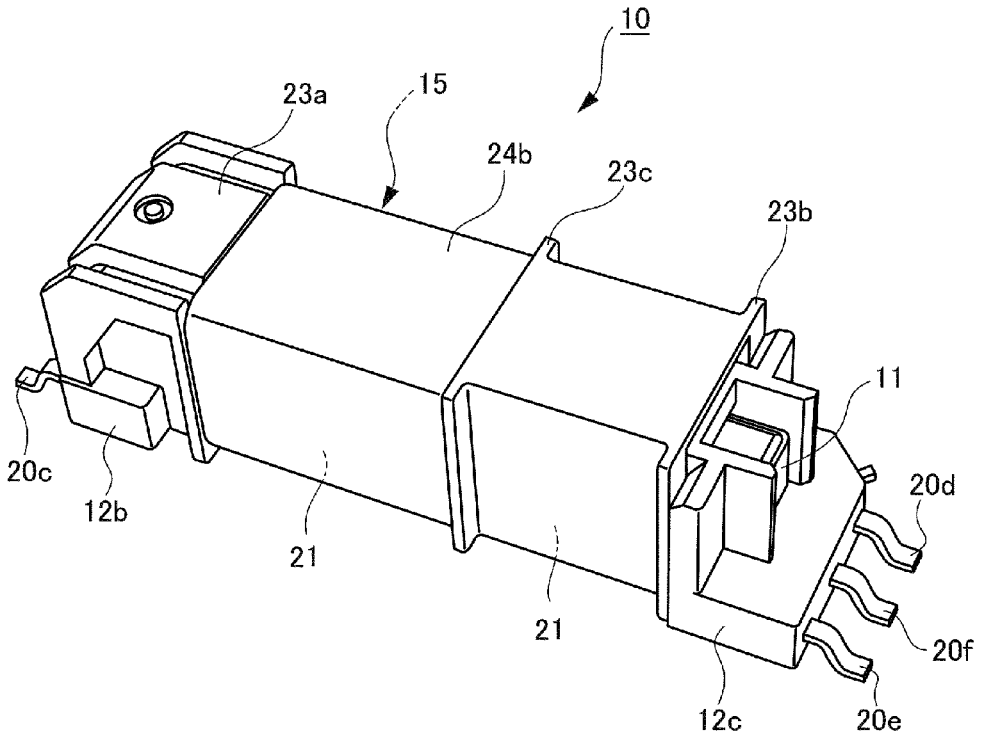
FIG. 2 is an external perspective view of the transformer according to one embodiment of the present invention, viewed from the rear side obliquely upward direction.
Figure 3:
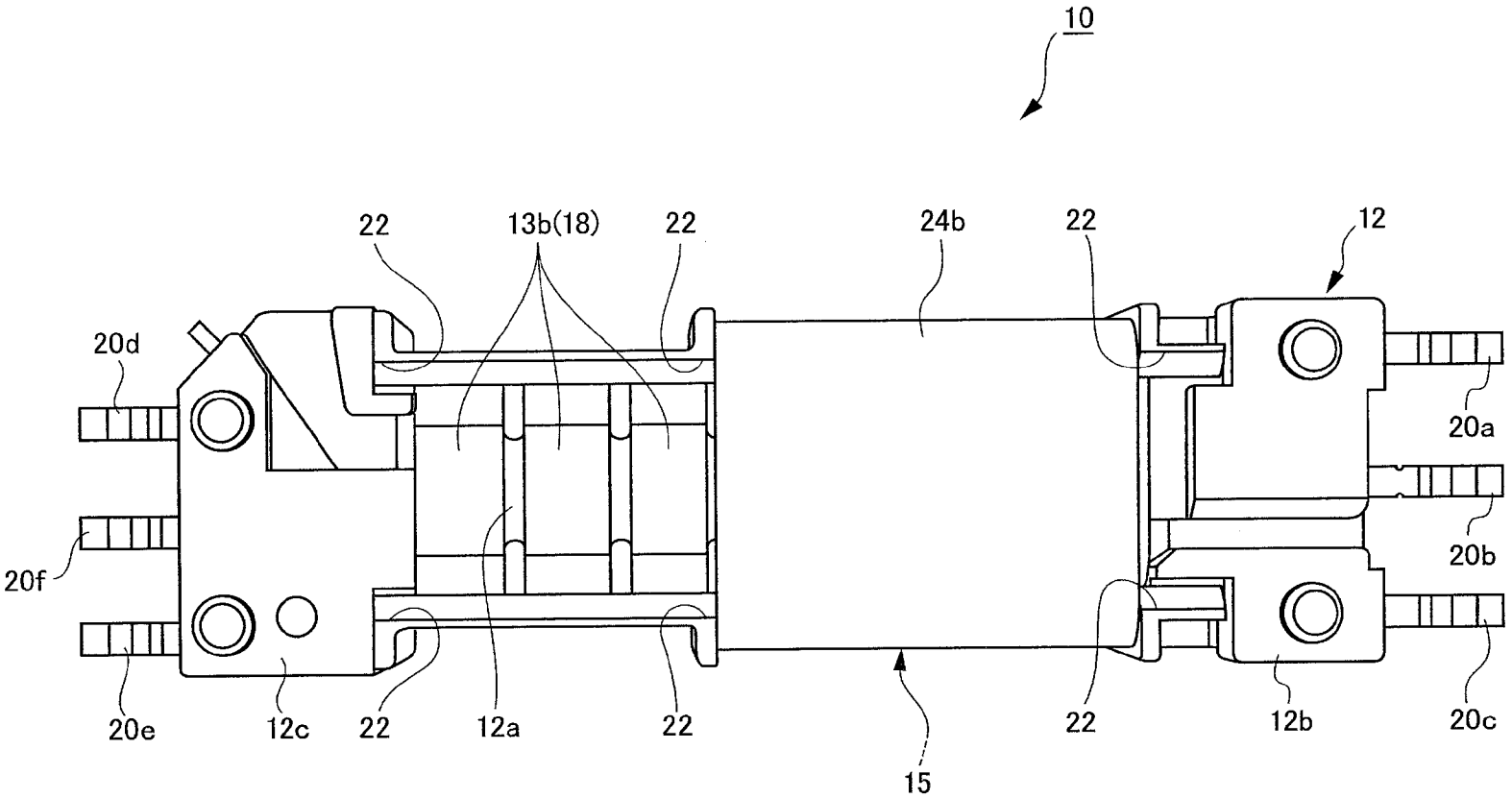
FIG. 3 is an enlarged plan view of the transformer according to one embodiment of the present invention, viewed from the lower side direction.
Figure 4:
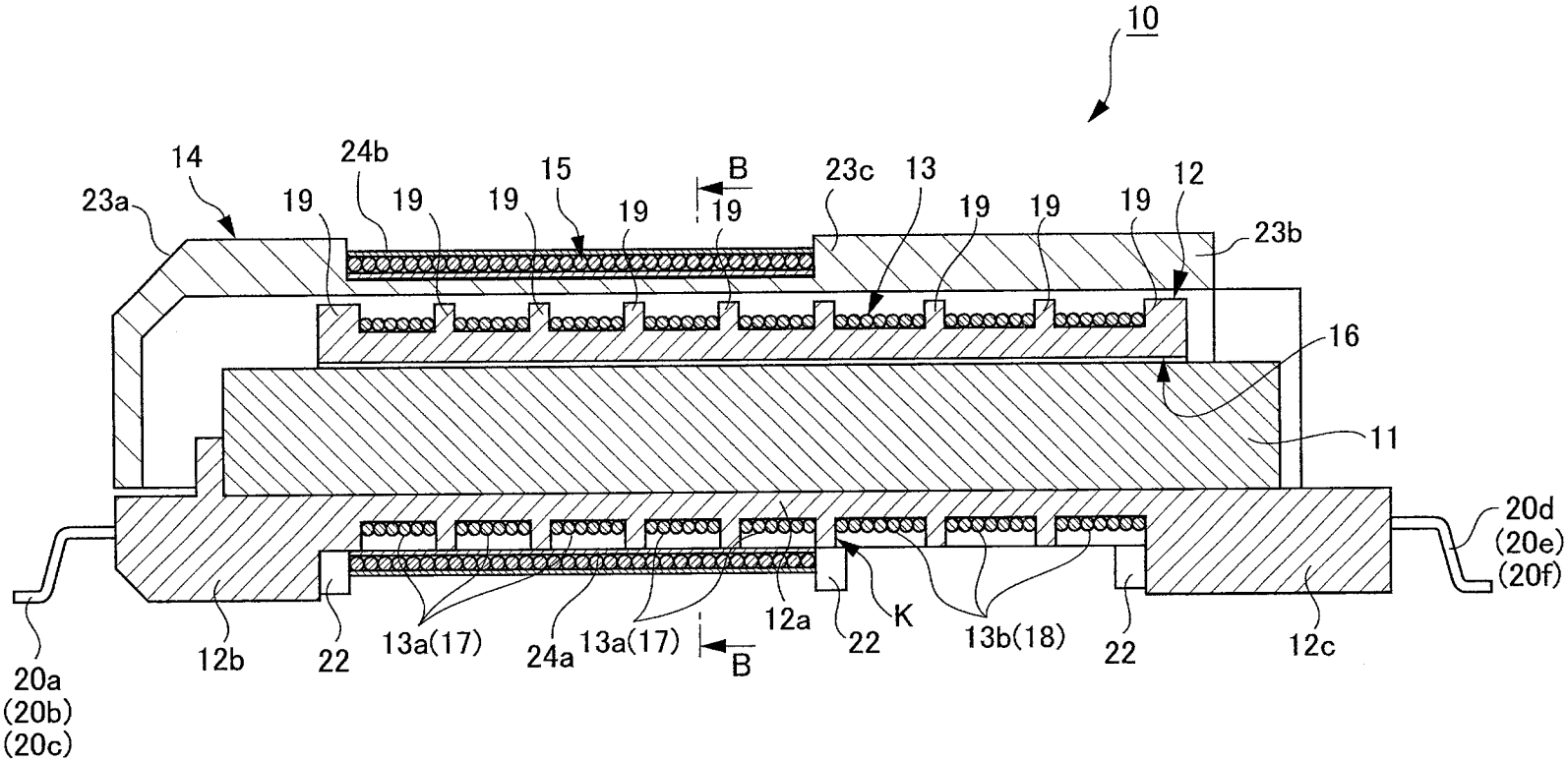
FIG. 4 is a line A-A schematic longitudinal sectional view of FIG. 2.
Figure 5:
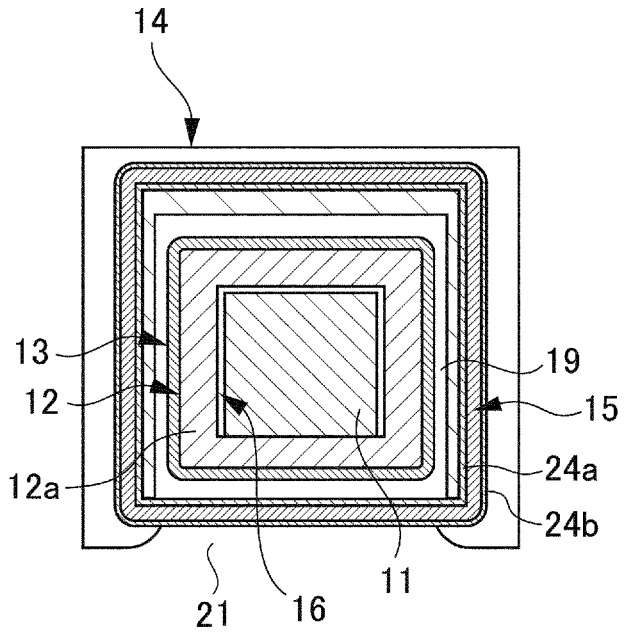
FIG. 5 is a line B-B schematic longitudinal sectional view of FIG. 4.

FIG. 1 and FIG. 2 illustrate a transformer according to one embodiment of the present invention. FIG. 1 is an external perspective view of the transformer, viewed from the front side obliquely upward direction. FIG. 2 is an external perspective view of the transformer, viewed from the rear side obliquely upward direction. FIG. 3 is an enlarged plan view of the transformer, viewed from the lower direction. FIG. 4 is a line A-A schematic longitudinal sectional view of FIG. 2. FIG. 5 is a line B-B schematic longitudinal sectional view of FIG. 4. In addition, The X-X direction of FIG. 1 is described as longitudinal direction, the Y-Y direction of FIG. 1 is described as horizontal direction and the Z-Z direction of FIG. 1 is described as vertical direction, A transformer 10 in FIG. 1 to FIG. 5 is an example of the high voltage transformer, and is configured by a core 11, a bobbin 12, a secondary winding 13 being wound onto the outer periphery of the bobbin 12, a casing 14 provided so as to cover the outer periphery of the bobbin 12, a primary winding 15 being wound onto the outer periphery of the casing 14 and the like. In addition, though the high voltage transformer is referred to as an example in this embodiment, the present invention is not limited to the high voltage transformer, but can be applied to general transformers widely.

The core 11 is an I type magnetic material core in a form of a rectangular parallelepiped, and is made of a ferrite material for example.

The bobbin 12 is made of a resin. As shown in detail in FIG. 4 to FIG. 7, the bobbin 12 is provided inside with a hollow portion 16 extending through longitudinally for accommodating and placing the core 11, and is formed integrally with a hollow main body 12*a* of a substantially cylindrical shape formed in a rectangular cross-sectional shape, and terminal blocks 12*b*, 12*c* which are provided at the front end and the rear end of the hollow main body 12*a*, respectively.

On the outer periphery portion of the hollow main body 12*a*, a low voltage side coil winding portion 17 that is formed by winding a low voltage side coil winding 13*a* (hereinafter referred to as "low voltage side coil winding 13*a*") of the secondary winding 13 which functions as a high voltage winding of the transformer 10, by a predetermined number of turns, and a high voltage side coil winding portion 18 that is formed by winding a high voltage side coil winding 13*b* (hereinafter referred to as "high voltage side coil winding 13*b*") of the secondary winding 13, by a predetermined number of turns, so that the winding starts from the end of the low voltage side coil winding portion 17, are arranged longitudinally in order. Further, on the outer periphery of the hollow main body 12*a*, a partition between the low voltage side coil winding portion 17 and the high voltage side coil winding portion 18, and a plurality of flange-like partition plate sections 19 which partition each of the inside of the low voltage side coil winding portion 17 and the high voltage side coil winding portion 18 into a plurality of sections, are provided integrally, at a distance from each other longitudinally.

The terminal block portion 12*b* is formed integrally with the hollow main body 12*a* in a state so that protrude toward outward forward direction longitudinally from the lower side of the hollow main body 12*a* in the low voltage side coil winding portion 17. The terminal block portion 12*c* is formed integrally with the hollow main body 12*a* in a state so that protrude toward outward forward direction longitudinally from the lower side of the hollow main body 12*a* in the high voltage side coil winding portion 18. In addition, in molding the bobbin 12, terminals 20*a*, 20*b*, 20*c* are provided to the terminal block portion 12*b* by insert molding and terminals 20*d*, 20*e*, 20*f* are provided to the terminal block portion 12*c* by insert molding.

As shown in detail in FIG. 4 to FIG. 7, the casing 14 is a resin molded body with a hollow portion inside and is attached to the bobbin 12 so as to cover the upper surface, the left and the right side surfaces in the horizontal direction and the front and the rear end surfaces in the longitudinal direction of the hollow main body 12*a*. On the lower surface of the casing 14, an opening 21 is provided for inserting the bobbin 12 into the inside.

Further, the opening 21 is provided with a plurality of retaining protrusions 22 of a claw shape on each of the left and right side surfaces. When the bobbin 12 is inserted to a predetermined position in the casing 14, the bobbin 12 is secured to the lower surface of the partition plate section 19, and is fixedly held and retained in the casing 14 by the retaining protrusions 22.

On the front end portion and the rear end portion of the outer periphery surface of the casing 14 onto which the primary winding 15 is to be wound which functions as the low voltage winding of the transformer 10, a front side partition plate section 23*a* and a rear side partition plate section 23*b* are formed, respectively.

Figure 6:
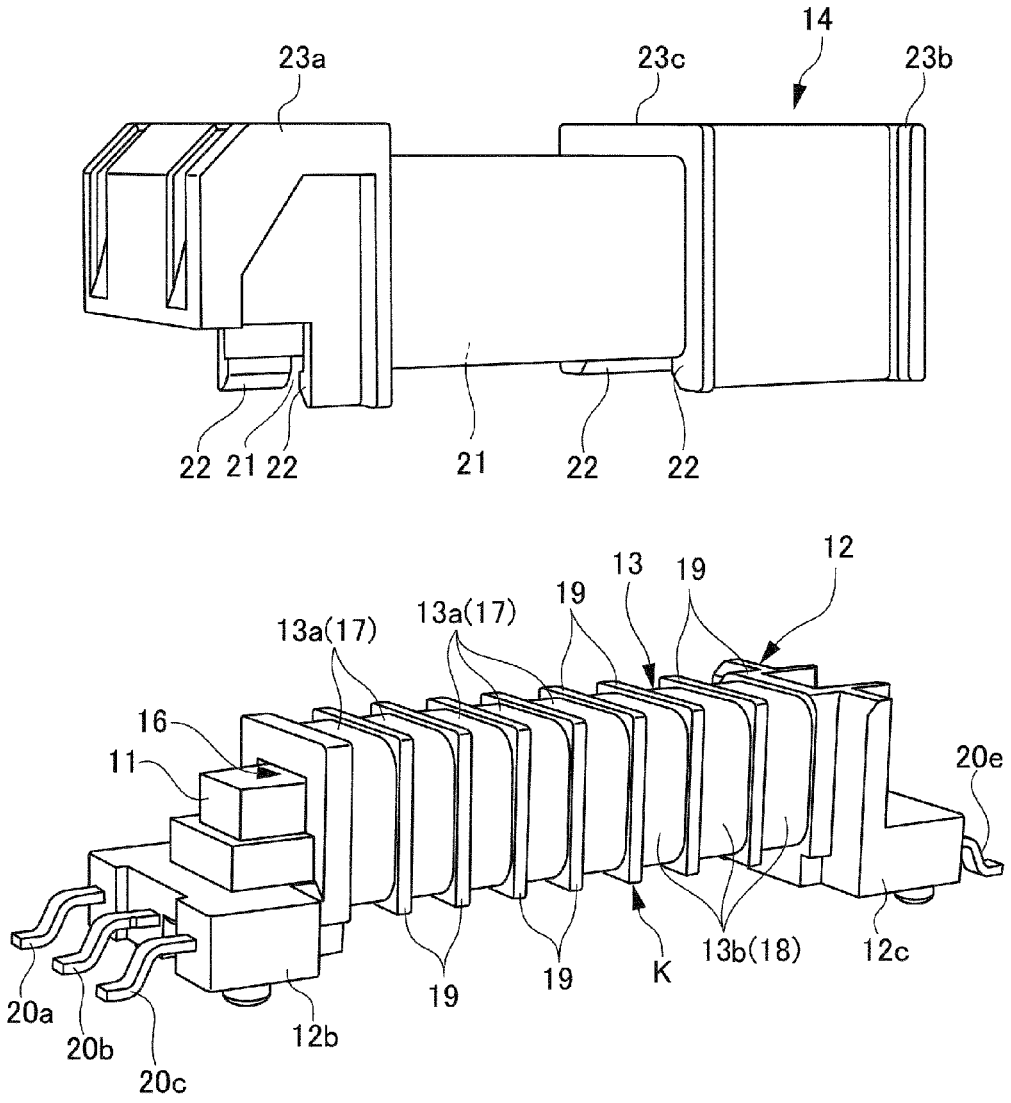
FIG. 6 is an exploded perspective view for explaining a state before attaching a casing to a bobbin of the transformer according to one embodiment of the present invention.

An intermediate partition plate section 23*c* is provided at a position substantially corresponding to the position of a partition plate section 19 which partitions between the low voltage side coil winding portion 17 and the high voltage side coil winding portion 18 being formed on the outer periphery of the hollow main body 12*a* in the bobbin 12 (the partition plate section 19 at the location pointed to by the arrow K in FIG. 4 and FIG. 6). The outer periphery surface of the casing 14 between the rear side partition plate section 23*b* and the intermediate partition plate section 23*c* is filled.

Then, by winding the primary winding 15 over all the outer periphery region between the front side partition plate section 23*a* and the intermediate partition plate section 23*c*, the both end portions of the primary winding 15 are fitted in position with the both end portions of the low voltage side coil winding 13*a* being wound to the low voltage side coil winding portion 17, and the primary winding 15 is wound in a state being overlapped with the low voltage side coil winding 13*a*.

Next, an example of the assembling procedure for the transformer 10 configured as above shall be explained. First, the low voltage side coil winding 13*a* of the secondary winding 13 is wound onto the low voltage side coil winding portion 17 of the bobbin 12, and following the low voltage side coil winding 13*a*, the high voltage side coil winding 13*b* of the secondary winding 13 is wound onto the high voltage side coil winding portion 18. In addition, at this time, the coil end of the low voltage side coil winding 13*a* is bound to the terminal 20*c*, and the coil end of the high voltage side coil winding 13*b* is bound to the terminal 20*d*. Further, if necessary, each of the coil ends and the terminals 20*c*, 20*d* are fixed by using a solder or the like.

Figure 7:
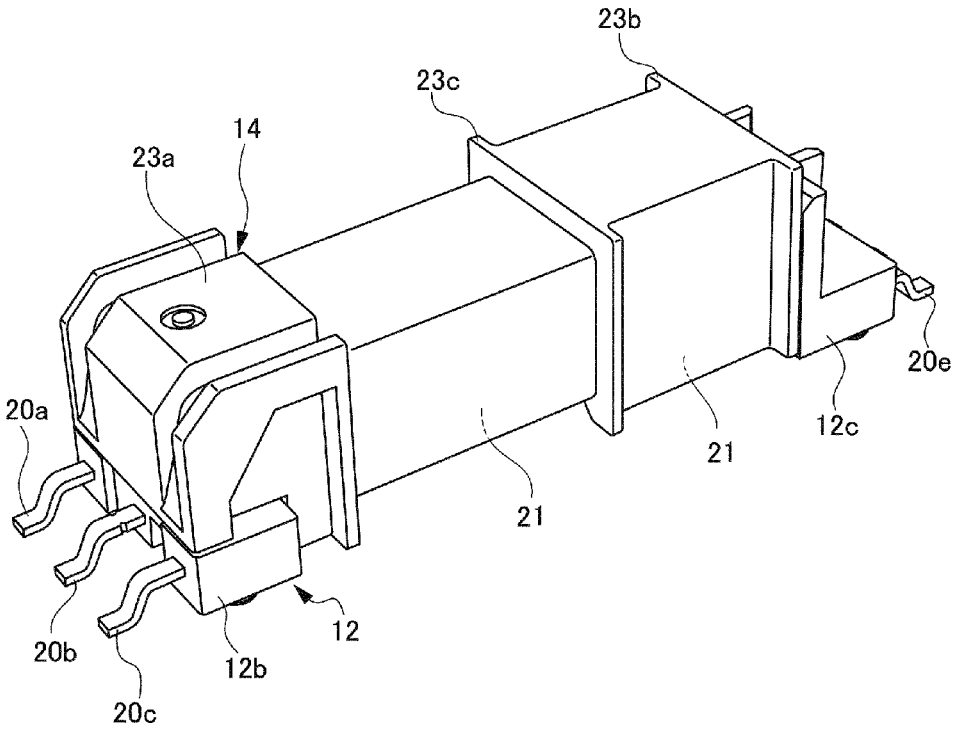
FIG. 7 is an explanatory view for explaining a state in which the casing is attached to the bobbin of the transformer according to one embodiment of the present invention.

Then, as shown in FIG. 6, the case 14 is covered over the bobbin 12 from the upper side onto which the low voltage side coil winding 13*a* and the high voltage side coil winding 13*b* are wound, and the hollow main body 12*a* of the bobbin 12 is inserted into the inside of the casing 14. When the bobbin 12 is inserted to a predetermined position in the casing 14, the engaging claws 22 of the opening 21 are secured to the lower surface of the partition plate section 19, the case 14 and the bobbin 12 are fixedly held each other and are integrated, in a state where the case 14 covers the upper surface, the left and the right side surfaces, and the front and the rear end surfaces. FIG. 7 illustrates a state immediately after the casing 14 and the bobbin 12 are integrated.

Subsequently, onto the position of the casing 14 on which the primary winding 15 is to be wound, that is the outer periphery portion corresponding to the region between the front side partition plate section 23*a* and the intermediate partition plate section 23*c*, an insulation tape 24*a* is wound by at least one turn, so that the insulation properties between the secondary winding 13 and the primary winding 15 to be wound thereafter are assured.

Then, the primary winding 15 is wound by a predetermined number of turns on the periphery region between the front side partition plate section 23*a* and the intermediate partition plate section 23*c* of the casing 14, and the coil ends are bound and connected to each of the terminal 20*a* and the terminal 20*b*. Further, if necessary, each of the coil ends and the terminals 20*a*, 20*b* are fixed by using a solder or the like. After the completion of the processing of the coil ends of the primary winding 15, an insulation tape 24*b* is would by at least one turn from the outside of the primary winding 15 so as to cover the outer periphery surface of the primary winding 15, and thereby a short-circuit of the primary winding 15 due to contact with external parts and the like is prevented. In this way, assembling is completed.

Accordingly, with regard to the transformer 10 configured in this way, by covering the bobbin 12 onto which the secondary winding 13 is wound with the casing 14 from the upper side of the bobbin 12 and accommodating the bobbin 12 to a predetermined position in the casing 14 from the side of the opening 21 of the casing 14, the hollow main body 12*a* is covered with the casing 14, and the engaging claw 22 of the casing 14 engages and retains the bobbin 12, and the bobbin 12 and the casing 14 can be easily fixed together and integrated. Therefore, the work of filling the insulation resin between the casing 14 and bobbin 12 which has been performed in a conventional configuration of the transformer for fixing the bobbin and the casing grows unnecessary.

Further, when accommodating the bobbin 12 in the casing 14, in the case the opening 21 is provided to the lower surface of the casing 14 and the bobbin 12 is covered with the casing 14 from the upper side of the bobbin 12 as disclosed in the configuration of the present example, it is enough to provide an opening 21 having a size of at least the outer diameter of the bobbin 12. As a result, the size of the bobbin 12 can be reduced, downsizing of the transformer 10 becomes possible, and an effect by the higher coupling coefficient can be obtained by getting closer the distance between the primary winding 15 and the secondary winding 13.

Further, it is different from the configuration of the conventional transformer in which the casing and the bobbin are integrated by using through-holes and the like of the printed circuit board side, and so the shape does not depend on the printed circuit board and the like, and a shape configuration having general versatility can be employed.

Further, because the primary winding 15 is wound to the portion overlapping with the low voltage side winding 13*a* of the secondary winding 13, fitting both ends of the primary winding 15 of to both ends of the low voltage side winding 13*a* of the secondary winding 13, the parasitic capacitance generated in the high voltage side winding 13*a* of the secondary winding 13 by the primary winding 15 can be reduced. Thus, the electric power loss at high frequencies can be reduced. In addition, because the energy stored in the parasitic capacitance increases with increasing potential between the primary winding 15 and the secondary winding 13, it grows possible to reduce the energy stored in the parasitic capacitance, and thereby reduce the electric power loss due to the leakage current at high frequencies, by winding the primary winding 15 over the outer periphery of the low voltage side coil winding 13*a* of the secondary winding 13. Further, the primary winding 15 is wound onto the outer periphery of the casing 14 so as to overlap with the low voltage side coil winding 13*a* of the secondary winding 13, and so the insulation properties between the primary winding 15 and the secondary winding 13 can be assured.

Further, by winding the primary winding 15 onto the outer periphery of the casing 14, it grows possible to shorten the longitudinal length of the transformer, as compared to a type of the transformer where the primary winding and the secondary winding are wound on a same bobbin. In addition, according to experiments, the coupling coefficient for the type of the transformer where the primary winding and the secondary winding are wound on the same bobbin is about 0.55, whereas the coupling coefficient for the configuration of the present example where the primary winding 15 is wound onto the outer periphery of the casing 14 is about 0.9. Therefore, the coupling coefficient can be improved.

Figure 8:
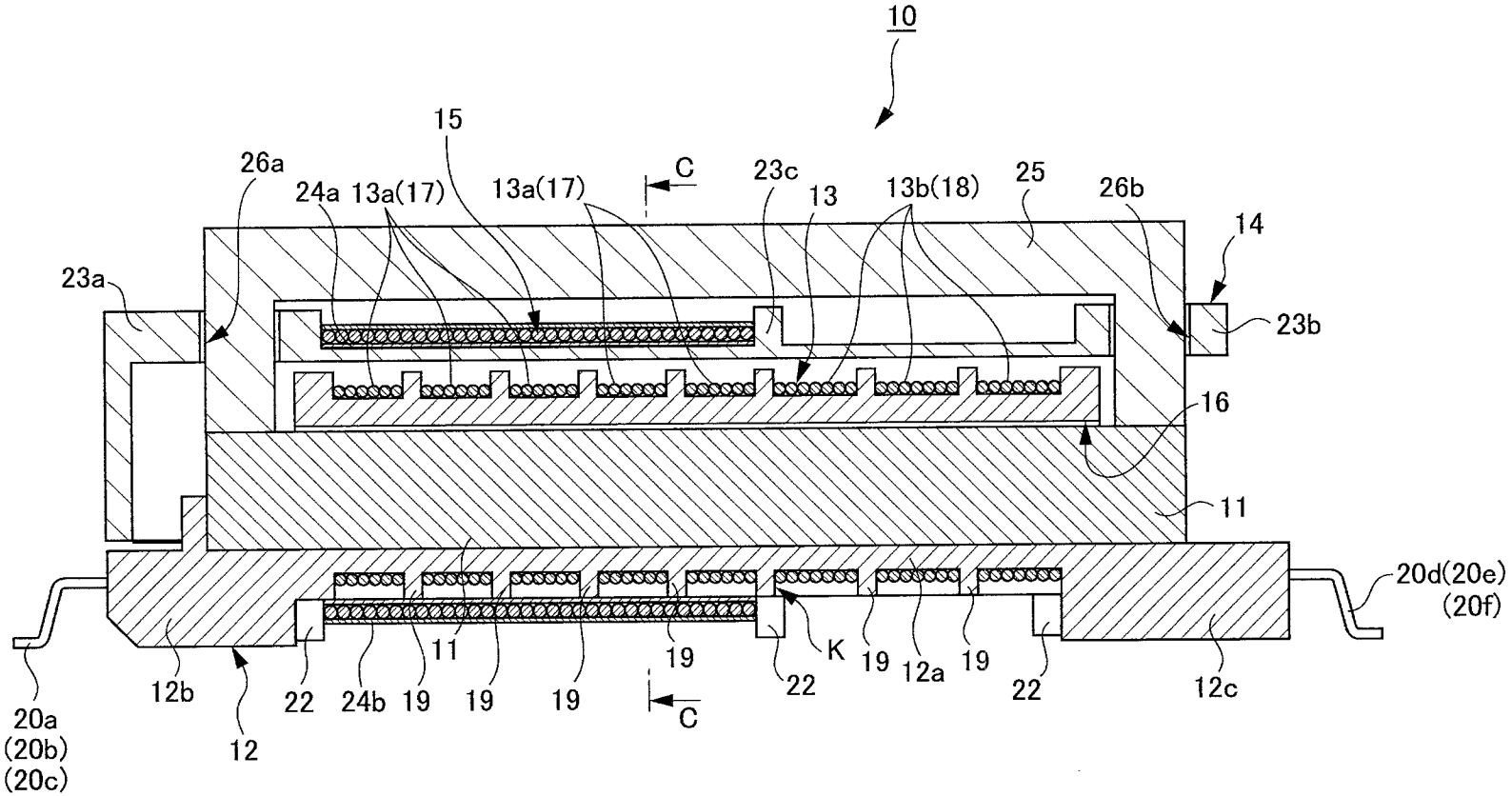
FIG. 8 is a schematic longitudinal sectional view showing a transformer according to another embodiment of the present invention.
Figure 9:
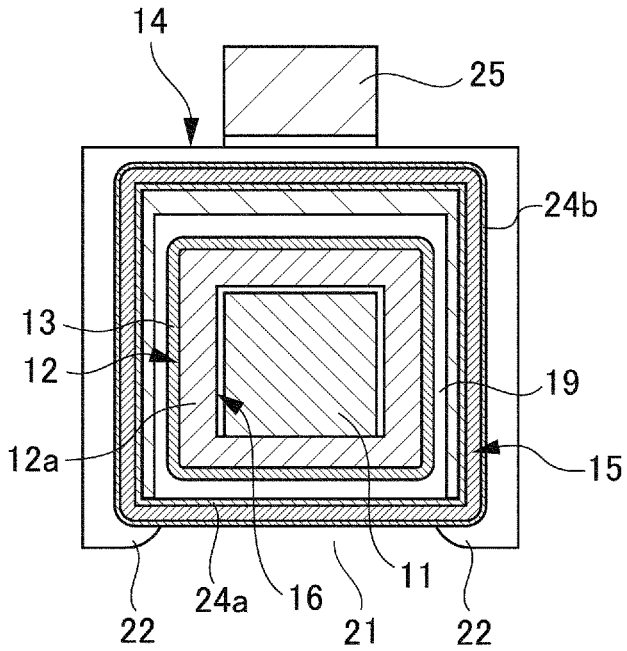
FIG. 9 is a line C-C schematic longitudinal sectional view of FIG. 8.

FIG. 8 and FIG. 9 illustrate a transformer according to another embodiment of the present invention. FIG. 8 is a schematic longitudinal sectional view of the transformer. FIG. 9 is a line C-C schematic longitudinal sectional view of FIG. 8.

The transformer 10 shown in FIG. 8 and FIG. 9 has a configuration where the core is composed of the I type magnetic material core 11 and a C type magnetic material core 25. The other configurations are the same as those of the transformer 10 as shown in FIG. 1 to FIG. 7. Therefore, the same reference numerals are given to the same components, and the duplicated description is omitted.

In FIG. 8 and FIG. 9, the inside width between both the end portions of the C type magnetic material core 25 is approximately equals to the distance between the outer surfaces in the longitudinal direction of the hollow main body 12*a* of the bobbin 12. In addition, the C type magnetic material core 25 is disposed on the upper surface outside of the casing 14, both the end portions thereof are inserted to the inside from each of through-holes 26*a*, 26*b* of the casing 14, and are disposed in a state where the end portions are opposed and approximated to each of the I type magnetic material core 11, and then the C type magnetic material core 25 and the I type magnetic material core 11 are configured to form a closed magnetic circuit.

In this way, in the transformer 10 in which the I type magnetic material core 11 and the C type magnetic material core 25 form the closed magnetic circuit, the leakage magnetic flux can be reduced further.

Further, though the transformer has been described as another embodiment which uses both the C type magnetic material core 25 and the I type magnetic material core 11, the transformer can be configured by using only two pieces of the C type magnetic material cores, without using the I type magnetic material core 11. Further, the C type magnetic material core can be configured not on the upper surface outside of the casing, but on the side surface outside of the casing.

Meanwhile, in the present embodiments, it has been described that the primary winding functions as a low voltage winding, and the secondary winding functions as a high voltage winding, but the input voltage can be applied to either the primary winding or the secondary winding, and the output voltage comes from the secondary winding or the primary winding respectively in that case.

As above, the present invention has been described with reference to the embodiments, but it is needless to say that the technical scope of the present invention is not limited to the scope described in the above embodiments. It is apparent to those skilled in the art that a variety of modifications or improvements other than the above can be made.

INDUSTRIAL APPLICABILITY

In the above described embodiments, the description has been made on the case where the present invention is applied to the high voltage transformer, but the present invention can be applied to a part having a winding other than the high voltage transformer.

REFERENCE SIGNS LIST

10 . . . transformer, 11 . . . core (I type magnetic material core), 12 . . . bobbin, 12*a* . . . hollow main body, 12*b* . . . terminal block portion, 12*c* . . . terminal block portion, 13 . . . secondary winding, 13*a* . . . low voltage side coil winding, 13*b* . . . high voltage side coil winding, 14 . . . casing, 15 . . . primary winding, 16 . . . hollow portion, 17 . . . low voltage side coil winding portion, 18 . . . high voltage side coil winding portion, 19 . . . partition plate section, 20*a* to 20*f* . . . terminals, 21 . . . opening, 22 . . . retaining protrusion (engaging claw), 23*a* . . . front side partition plate section, 23*b* . . . rear side partition plate section, 23*c* . . . intermediate partition plate section, 24*a* . . . insulation tape, 24*b* . . . insulation tape, 25 . . . core (C type magnetic material core), 26*a* and 26*b* . . . through-holes

The invention claimed is:

1. A transformer comprising:

a core;

a primary winding;

a secondary winding;

a bobbin comprising a low voltage side coil winding portion and a high voltage side coil winding portion juxtaposed to the low voltage side coil winding portion in a longitudinal direction of the bobbin, wherein the secondary winding is wound onto each of the coil winding portions; and a casing disposed so as to cover all of the coil winding portions of the bobbin comprising at least an upper surface, opposing side surfaces extending perpendicularly from the upper surface, and a front surface connected to the upper surface and the opposing side surfaces and disposed adjacent to the lower voltage side coil winding portion, wherein the primary winding is wound onto only an area of an outer periphery of the casing corresponding to the low voltage side coil winding portion, and wherein at least one groove is continuously formed in at least a portion of the upper surface and at least a portion of the front surface to guide an end of the primary winding to a terminal therealong.

2. The transformer according to claim 1, wherein the secondary winding is a high voltage winding and the primary winding is a low voltage winding, and the primary winding is placed and wound in a portion corresponding to an area between the both ends of the low voltage side coil winding portion.

3. The transformer according to claim 1, wherein the casing is provided with an insulation tape onto the outer periphery thereof where the primary winding is wound.

4. The transformer according to claim 2, wherein the casing is provided with an insulation tape onto the outer periphery thereof where the primary winding is wound.

5. The transformer according to claim 1, wherein the core comprises an I type magnetic body core and a C type magnetic body core.

6. The transformer according to claim 2, wherein the core comprises an I type magnetic body core and a C type magnetic body core.

7. The transformer according to claim 3, wherein the core comprises an I type magnetic body core and a C type magnetic body core.

8. The transformer according to claim 4, wherein the core comprises an I type magnetic body core and a C type magnetic body core.

9. The transformer according to claim 1, wherein an end of the low voltage side coil winding portion is disposed adjacent to an end of the bobbin in the longitudinal direction of the bobbin, and wherein an end of the high voltage side coil winding portion away from the low voltage side coil winding portion is disposed adjacent to an opposite end of the bobbin in the longitudinal direction of the bobbin.

10. The transformer according to claim 1, wherein the casing is formed in a hollow box-shaped body provided with an opening on a lower surface of the outer periphery thereof for receiving and accommodating the bobbin therein, and the opening has a retaining protrusion of a claw shape extending downwardly from the casing to engage the accommodated bobbin.

11. The transformer according to claim 1, wherein the bobbin further comprises a terminal block portion, and wherein the front surface of the casing is positioned on the terminal block portion so that the end of the primary winding connects to the terminal, which is partially inserted in the terminal block portion, through the grooves.

* * * * *